US006055679A

United States Patent [19]

Goelz et al.

[11] Patent Number: 6,055,679

[45] **Date of Patent: *May 2, 2000**

[54] PASSIVE LAVATORY CLEANSER DISPENSING SYSTEM

[75] Inventors: John F. Goelz, Milwaukee; Michael E. Klinkhammer; Mark E. Wefler, both of Racine, all of Wis.

[73] Assignee: S. C. Johnson & Son, Inc., Racine, Wis.

[ * ] Notice: This patent is subject to a terminal disclaimer.

[21] Appl. No.: 08/398,040

[22] Filed: Mar. 3, 1995

[51] Int. Cl.[7] ..... E03D 9/03

[52] U.S. Cl. ..... 4/227.6

[58] Field of Search ..... 4/227.1, 227.4, 4/227.5, 227.6, 227.7

[56] References Cited

U.S. PATENT DOCUMENTS

| | | | |
|---|---|---|---|
| Re. 32,017 | 11/1985 | Hautmann et al. . | |
| D. 283,726 | 5/1986 | Jones et al. | D23/3 |
| D. 292,605 | 11/1987 | Shaer et al. | D23/208 |
| D. 293,263 | 12/1987 | Ronayne | D23/208 |
| D. 345,195 | 3/1994 | Kelly . | |
| D. 345,196 | 3/1994 | Kelly . | |
| 3,618,143 | 11/1971 | Hill et al. . | |
| 3,943,582 | 3/1976 | Daeninckx et al. | 4/227 |
| 4,043,931 | 8/1977 | Jeffrey et al. . | |
| 4,216,027 | 8/1980 | Wages | 134/36 |
| 4,269,723 | 5/1981 | Barford et al. . | |
| 4,281,421 | 8/1981 | Nyquist et al. | 4/228 |
| 4,308,625 | 1/1982 | Kitko . | |
| 4,375,109 | 3/1983 | Jones | 4/228 |
| 4,419,771 | 12/1983 | Richards | 4/228 |
| 4,438,534 | 3/1984 | Keyes et al. | 4/227 |
| 4,453,278 | 6/1984 | Doggett et al. | 4/227.7 |
| 4,459,710 | 7/1984 | Keyes et al. . | |
| 4,480,341 | 11/1984 | Richards | 4/228 |
| 4,480,342 | 11/1984 | Jones | 4/227.7 |
| 4,485,500 | 12/1984 | Melville, Jr. | 4/228 |
| 4,707,865 | 11/1987 | Ludwig et al. . | |
| 4,707,866 | 11/1987 | Phillipp et al. . | |
| 4,709,423 | 12/1987 | Richards | 4/228 |
| 4,722,801 | 2/1988 | Bunczk et al. . | |
| 4,722,802 | 2/1988 | Hutchings et al. . | |
| 4,738,833 | 4/1988 | Gray | 422/266 |
| 4,745,638 | 5/1988 | Richards . | |
| 4,764,992 | 8/1988 | Delia . | |
| 4,820,449 | 4/1989 | Menke et al. . | |
| 4,937,893 | 7/1990 | Iding et al. | 4/228 |
| 4,962,549 | 10/1990 | King | 4/227.6 |
| 5,317,762 | 6/1994 | Horst et al. . | |

*Primary Examiner*—Charles E. Phillips

[57] ABSTRACT

This invention relates to dispensing systems, such as lavatory cleansing systems, particularly dispensers suitable for placement into a liquid containing vessel whose level of liquid is capable of changing from an upper level to a lower level and vice versa, such as a toilet tank. These dispensers dispense and deliver a conserved amount of lavatory cleanser, into the liquid containing tank by controlling the rate at which water enters the dispenser. This invention also relates to a controlled solubility lavatory cleanser for use in conjunction with the dispenser.

53 Claims, 6 Drawing Sheets

PASSIVE LAVATORY CLEANSER DISPENSING SYSTEM

FIELD OF THE INVENTION

The present invention relates to dispensing systems, such as lavatory cleansing systems, which employ a dispenser suitable for mounting in a liquid containing vessel whose level of liquid is capable of changing from an upper level to a lower level and vice versa, such as a toilet tank. The lavatory cleansing systems of this invention employ a lavatory cleanser composition which is dispensed from the dispenser in diluted or solubilized conserved amounts.

BACKGROUND OF THE INVENTION

Toilet bowl cleaners, such as those in the form of lavatory cleansing blocks and automatic toilet bowl cleanser dispensers, are well known.

Conventional lavatory cleansing blocks are placed directly into a toilet tank without the use of dispensing devices. In this way, the lavatory cleansing blocks are allowed to settle to the bottom of the toilet tank, typically assisted by the addition of a salt to "weight" down the lavatory cleansing blocks. The lavatory cleansing blocks then dissolve slowly over time thereby releasing to the toilet water the cleansing agents contained therein. Such known lavatory cleansing blocks are typically formulated with sufficient amounts of water-insoluble surfactants to increase the time the lavatory cleansing blocks may exist in the toilet tank without completely dissolving.

The water solubility of the known lavatory cleansing blocks is often controlled by employing a hydrophobic or water-insoluble material in combination with a water-soluble surfactant. For example, U.S. Pat. Nos. 4,722,802 (Hutchings et al.) and 4,269,723 (Barford et al.) refer to a composition and process for making lavatory blocks from the composition. The Barford patent also describes the inclusion of other water-insoluble release agents, such as clays and water-dispersible polymers, in the compositions. In addition, U.S. Pat. Nos. 4,043,931 (Jeffrey et al.) and 4,308,625 (Kitko) refer to compositions said to be useful for lavatory cleansing blocks, that employ two nonionic surfactants, one of which is relatively water-insoluble and the other of which is relatively water-soluble. U.S. Pat. No. 4,820,449 (Menke et al.) also refers to a lavatory cleansing block which comprises water-soluble surfactants, such as $C_{12}$–$C_{14}$ alkyl sulfate sodium salts, and water-insoluble surfactants, such as mono- or di-alkanolamides. U.S. Pat. No. 4,722,801 (Bunczk et al.) refers to lavatory block compositions whose rate of dissolution is controlled through the use of polyethylene glycol distearate. Lavatory cleansing blocks so prepared impart surfactants to the flush water as cleansers and detergents at a rate that allows these blocks to have longer effective in-use life-spans than lavatory cleaning blocks prepared without the hydrophobic/water-insoluble material, which dissolve in the water of the toilet tank much more readily.

However, these types of lavatory cleansing blocks have certain drawbacks. For instance, in controlling the rate of water solubility, the hydrophobic or water-insoluble materials included in the lavatory cleansing block compositions (1) commonly add excess weight and bulk to the lavatory cleansing blocks; (2) compromise the effectiveness of the active ingredient(s) (e.g., cleansing and disinfectant agents and the like) in the lavatory cleansing blocks due at least in part to the deposition of water-insoluble materials on the surfaces of the toilet tank and toilet bowl which remain over long contact times; and (3) make the availability of active ingredient in the lavatory cleansing blocks sensitive to differences in turbulence and water temperature found in toilets throughout the United States.

In addition, use of these hydrophobic/water-insoluble materials in lavatory cleansing blocks fosters inconsistent delivery to the flush water of the active ingredients, with the quiescent period between flushes dictating the delivered concentration of those ingredients. That is, while such lavatory cleansing blocks tend to deliver a concentrated amount of active ingredient when the toilet is flushed after having been in the quiescent period between flushes for prolonged periods of time, they tend to deliver a more dilute amount of active ingredient after repeated or frequent flushes of the toilet.

Overcoming any or all of these problems would be met with keen consumer and commercial interest.

Dispensers have also been widely used to deliver predetermined amounts of liquid toilet cleansers to the toilet bowl. See e.g., U.S. Pat. Nos. 4,459,710 (Keyes et al.), 4,707,865 (Ludwig et al.), 4,707,866 (von Philipp et al.) and 4,764,992 (Delia). Certain of these dispenser have typically been characterized as "active" dispensers since valves or other mechanisms are used to initiate flow from the dispenser when the toilet tank is emptied to a given level. Others of these dispensers have been characterized as "passive" dispensers when no moving parts are used and the predetermined amount of liquid cleanser is dispensed solely by the actuation of the lowering of the water level in the toilet tank. See e.g., U.S. Pat. No. 4,745,638 (Richards), and the U.S. patents referred to therein.

Often, the passive dispensers deliver the liquid toilet cleansers by means of an air lock, a siphon or a combination thereof. The intent of these delivery means is to prevent uncontrolled diffusion between the liquid toilet cleanser and the water in the toilet tank. In addition, with these delivery means, all of the predetermined amount of liquid toilet cleanser typically evacuates from the dispenser into the toilet tank, leaving substantially no residual volume of liquid toilet cleanser remaining in the dispenser.

Such conventional dispensers are also typically sealed, either permanently or temporarily. Even when a temporary seal is used, many consumers generally remove the dispensers from the toilet tank to replenish the supply of liquid or solid toilet cleanser. Accordingly, a dispenser which is refillable but not sealed would result in greater commercial acceptance. Moreover, many consumers discard temporarily sealed dispensers rather than replenish their supply of liquid or solid toilet cleanser. In the latter case, an environmental concern is raised. In that vein, a refillable dispenser should reduce the amount of waste created by reducing the number and frequency of discarded dispensers. Therefore, there is a need for a lavatory cleansing system that delivers to the toilet bowl a lavatory cleanser composition with an enhanced degree of concentration consistency when the toilet is flushed frequently or repetitively. There is also a need for disposing within the dispenser a concentrated or viscous liquid lavatory cleanser composition which may be diluted, or a solid lavatory cleanser composition which may be solubilized to provide an effective amount of lavatory cleanser when the toilet is flushed with enhanced consistency from flush-to-flush. There is a need for a lavatory cleanser composition that contains fewer or none of the hydrophobic/water-insoluble materials found in conventional lavatory cleansing blocks so that the effectiveness of the cleanser is not compromised by water-insoluble deposits. In addition, there is a need for a lavatory cleansing system which counters the affect of sensitivity to differences of water turbulence in toilet tanks on the life-span of conventional lavatory cleaning blocks. And there is a need for an easily refillable dispenser for use in a lavatory cleansing system.

In meeting those needs, it would be desirable to provide a dispenser that may use in conjunction therewith a lavatory cleanser composition whose rate of solubility may be controlled by the dispenser and allows for effective delivery to the toilet tank over extended periods of time. It would also be desirable to provide such a dispenser that is easily refillable while mounted for use in a toilet tank.

SUMMARY OF THE INVENTION

The present invention overcomes the aforementioned drawbacks associated with known lavatory cleansing blocks and dispensers for lavatory cleansers by providing a lavatory cleansing system comprising a reusable dispenser for dispensing a lavatory cleanser into a toilet tank for delivery in flush water to the toilet bowl which is capable of controlling the degree to which a liquid or gel lavatory cleanser composition disposed within becomes more fluid or dilute or the degree to which a solid lavatory cleanser composition dissolves.

The lavatory cleansing system of this invention delivers a lavatory cleanser to the toilet bowl with a more consistent concentration from flush-to-flush and provides enhanced cleansing capabilities as compared with conventional lavatory cleansing blocks.

More specifically, the present invention provides a lavatory cleansing systems comprising: (a) a refillable dispenser adapted for mounting in a toilet tank; and (b) lavatory cleanser composition. The dispenser comprises (i) at least one chamber, the chamber having a lower portion closed at its bottom end, and an upper portion open at its top end, the top end capable of receiving a lavatory cleansing composition; and (ii) at least one inlet/outlet means, where the lavatory cleanser composition is disposed within a lower portion of the chamber. A proximal end of the inlet/outlet means is attached to the chamber and a distal end of the inlet/outlet means is positioned below its proximal end and toward the lower portion of the chamber. The inlet/outlet means is in fluid communication with water in the toilet tank and allows for the entry of water from the toilet tank into the chamber after the toilet is flushed. The turbulence generated by the entering water assists in diluting or solubilizing the lavatory cleanser composition disposed in the chamber, pushing the diluted or solubulized cleaner into an upper portion of the chamber, and when the toilet is flushed, the diluted or solubilized lavatory cleanser composition is dispensed into the toilet tank through the inlet/outlet means for delivery to the toilet bowl.

The lavatory cleansing systems of this invention provide a reusable dispenser that is capable of generating a sufficient amount of turbulence from water which enters therein from the toilet tank to dilute or solubilize a lavatory cleansing composition disposed therein. A conserved amount of the diluted or solubilized lavatory cleanser composition may then be dispensed from the dispenser.

This invention further provides lavatory cleanser compositions suitable for use in a dispenser of this invention, whose degree of dilution or dissolution may be controlled by the dispenser in which it is disposed.

In a more general aspect of the present invention, a dispensing system is provided in which a dispenser is adapted for mounting in a liquid containing vessel which is capable of generating a sufficient amount of turbulence from water which enters therein from the vessel to dilute or solubilize a material disposed therein. A conserved amount of the diluted or solubilized material may then be dispensed from the dispenser.

And this invention provides dispensers that are refillable, even while mounted in a liquid containing vessel, such as a toilet tank with which it is to be used.

The combination of lavatory cleanser compositions with the dispensers as described in greater detail hereinafter and depicted in the figures, provide an efficient lavatory cleanser with an enhanced effective life-time, and enables the art-skilled to use a lavatory cleanser composition that does not contain the hydrophobic/water-insoluble materials of conventional lavatory blocks. By omitting such hydrophobic/water-insoluble materials in the lavatory cleanser compositions used in the present invention, excess weight and bulk may be reduced and water-insoluble deposits on the surfaces of the toilet tank and toilet bowl may be minimized and consistent delivery may be provided when the toilet is flushed frequently.

Moreover, because of turbulence fluctuations in toilet tanks with different dimensions and in different geographic locations throughout the United States, conventional lavatory cleansing blocks may be adversely impacted. However, the affect of such turbulence fluctuations in the lavatory cleanser compositions may be minimized or negated by the dispenser, which itself generates a desired amount of turbulence from water which enters the dispenser through the inlet/outlet means when the toilet tank refills after the toilet is flushed. This turbulence assists in diluting or solubilizing the lavatory cleanser compositions to a controlled extent thereby providing an appropriate concentration of the lavatory cleanser compositions for dispensing into the toilet tank and delivery to the toilet bowl.

Thus, the present invention exemplifies an advance that will become more readily apparent and appreciated by a study of the detailed description taken in conjunction with the figures which follow hereinafter.

DETAILED DESCRIPTION OF THE INVENTION

Figure 1A:
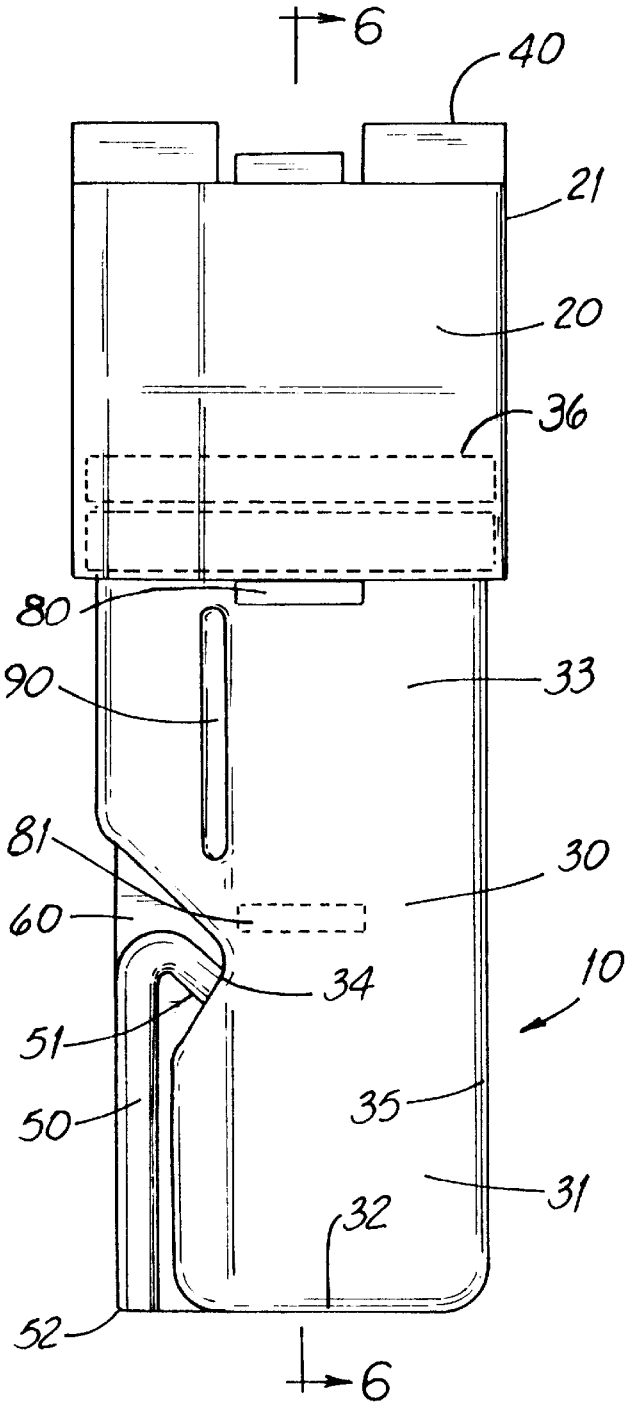
FIG. 1A depicts a frontal view of a dispenser of this invention into which a lavatory cleanser composition may be disposed.

The present invention relates to lavatory cleansing systems, each of which includes a reusable dispenser and a lavatory cleanser composition. The dispenser is capable of controlling the degree of dilution or solubilization of a liquid or gel, or solid lavatory cleanser composition, respectively, disposed therein. The lavatory cleanser composition is diluted or solubilized by water entering the dispenser from the toilet tank within which it is mounted. When the toilet is flushed, the dispenser dispenses a consistent amount of lavatory cleanser composition into the water of the toilet tank which is delivered to the toilet bowl. With the dispenser of the lavatory cleansing system, the skilled artisan may make appropriate choices of components to prepare a material suitable for use as a lavatory cleanser composition having any of a variety of fragrances, colors and/or cleansing capabilities, and whose effective in-use life-span may also be controlled and varied as desired. When the life-span of the particular cleanser composition has ended, another cleanser may be readily placed into the dispenser while the dispenser is still mounted in the toilet tank.

The lavatory cleanser compositions suitable for use in conjunction with the dispensers as depicted herein and described in greater detail hereinafter, may comprise active ingredients, such as cleansing agents like surfactants and/or oxidants, fragrance components and coloring agents or dyes. Of course, other components may also be added to the lavatory cleanser compositions. Included among such components are disinfectants like quaternary ammonium compounds, and iodine complexes.

Suitable cleansing agents for use in the lavatory cleanser compositions of the present invention include conventional surfactants, such as anionic surfactants, nonionic surfactants, cationic and amphoteric surfactants.

A wide range of anionic surfactants are available, including, but not limited to, alkali metal salts of alkyl, alkenyl and alkylaryl sulfates and sulfonates. Such anionic surfactants are of the general formula $ROSO_3M$ and $RSO_3M$, where R may be an alkyl or alkenyl group of about 8 to about 20 carbon atoms, or an alkylaryl group, the alkyl portion of which may be a straight- or branched-chain alkyl group of about 9 to about 15 carbon atoms, the aryl portion of which may be phenyl or a derivative thereof, and M may be an alkali metal (e.g., sodium, potassium or lithium) or a nitrogen derivative (e.g, amino or ammonium). Anionic surfactants, such as sodium alkylaryl sulfonate sold commercially by Albright & Wilson, Warley, England under the trademark "NANSA" HS 85/S or Unger Fabrikker, Fredistad, Norway under the trademark "UFARYL" DL85 may also be used, either individually or in combination as a suitable surfactant.

Nonionic surfactants for use in the lavatory cleanser compositions of this invention include those having an appropriate hydrophobic/lipophobic balance ("HLB"). The HLB signifies a high degree of water-solubility, thus allowing for the use of such nonionic surfactants of the lavatory cleanser compositions of this invention. The HLB for such nonionic surfactants should be in the range of from about 6.0 to about 30.0, with about 12 to about 25 being desirable. Nonionic surfactants, such as alkylene oxide condensates, amides, semi-polar agents or glycerol stearates, may be used.

Alkylene oxide condensate-type nonionic surfactants include polyethoxylated aliphatic alcohols, where the alkyl group may have about 8 to about 20 carbon atoms, and the number of ethylene oxide units may be about 4 to about 12; polyethoxylated alkyl phenols, where the alkyl group may have about 6 to about 12 carbon atoms and the number of ethylene oxide units may be about 5 to about 25; difunctional block polymers of polyoxyalkylene derivatives of propylene glycol, and tetrafunctional polyether block polymers of polyoxyalkylene derivatives of ethylenediamine. Examples of these nonionic surfactants include those sold commercially by BASF Corp., Wyandotte, Mich. under the tradename "PLURONIC F" (block copolymers of propylene oxide and ethylene oxide—HLB: 18–24) series like "PLURONIC" F-108 (HLB:24.0) and "PLURONIC" F-127 (HLB: 18–23.0) and "PLURAFAC A" (oxyethylated straight chain alcohol) series such as "PLURAFAC A-38" (HLB: 19) and "PLURAFAC A-39" (HLB: 24).

Amide-type nonionic surfactants include ammonia and ethanolamine derivatives of fatty acids, where the acyl group contains from about 8 to about 18 carbon atoms.

Semi-polar-type nonionic surfactants include amine oxides, phosphine oxides and sulfoxides.

Glycerol stearate-type nonionic surfactants include glycerol and glycol esters, glycerides and ethoxylated fatty acids. Examples of commercially available glycerol stearate surfactants include those sold by Karlshamns USA, Inc., Columbus, Ohio under the trademarks "CAPMUL" like "CAPMUL" GMS (glycerol monostearate—HLB:3.2) and "CAPROL" like "CAPROL" 3GS (triglycerol monostearate—HLB:6.2) and "CAPROL" 6G2S (hexaglycerol distearate—HLB:8.5); Lonza, Inc., Fairlawn, N.J. under the trademarks "ALDO" like "ALDO" MS FG (glycerol mono- and di-stearates—HLB:4.0) and "PEGOSPERSE" like "PEGOSPERSE" 1500-MS glycol ester—polyethylene glycol (1500) monostearate—HLB:13.8; Of the glycol esters, examples of commercially available ones include those sold by; Calgene Chemical Corp., Skokie, Ill. under the trademark "CALGENE" like "CALGENE" 100-S glycol esters (polyoxyethylene glycol (1000) monostearate—HLB:15.6); Lipo Chemical, Inc., Paterson, N.J. under the trademark "LIPOMULSE" like "LIPOMULSE" 165 (self emulsifiable, acid stable, glycerol monostearate—HLB:11.0); and Goldschmidt Chemical Corp., Hopewell, N.J. under the trademark "TEGINACID" like "TEGINACID" X-SE (glycerol monostearate with other nonionics—HLB:12.0).

Examples of the glycerides include those sold commercially by Huls America, Inc., Piscataway, N.J. under the trademark "IMWITOR" such as "IMWITOR" 965 (mono- and di-glycerides of hydrogenated lard or tallow—HLB:13.0).

Examples of ethoxylated fatty acids include those commercially available from ICI Americas, Inc. Wilmington, Del. under the trademark "MYRJ" such as "MYRJ" 52 [polyoxyl (40) stearate—HLB:16.9] and Lipo Chemicals, Inc., Paterson, N.J. under the trademark "LIPOPEG" such as "LIPOPEG" 100-S (polyoxyethylene glycol (100) POE stearate—HLB:18.8).

Suitable amphoteric surfactants include betaine derivatives, such as complex coco betaine like Ampho B11-34 sold by Karlshanis USA, Inc, Columbus, Ohio; and the sodium salts of dicarboxylic coconut oil derivatives like "Miranol" C2M sold by Rhone-Poulenc Specialty Chemicals, Cranberry, N.J. The amphoteric surfactants are typically incorporated in combination with other surfactants within the lavatory cleanser compositions to regulate foaming and other properties thereof.

Cationic surfactants suitable for use in the present invention include stearyl dimethyl benzyl ammonium chloride, coconut dimethyl benzyl ammonium chloride, cetyl pyridinium chloride and cetyl trimethyl ammonium chloride.

Of course combinations of surfactants within individual surfactant classes as well as among these surfactant classes may also be used in the lavatory cleanser compositions of this invention. A non-exhaustive recitation of such surfactants may be gleaned from McCutcheon's Emulsifiers & Detergents, North American edition (1988).

In addition, oxidants may be used instead of or in addition to certain of such cleansing agents. The oxidants should have a sufficient degree of water-solubility to make the resulting lavatory cleanser composition in which it is employed practicable for use with the dispensers of this invention.

Suitable oxidants include those that contain or generate in aqueous solution the hypochlorite ion ("$OCl^-$"). Of these oxidants or bleaching agents, trichloroisocyanuric acid ("TCCA") is an appropriate choice, for use either alone or in combination with other oxidants or cleansing agents. TCCA is available commercially from a variety of sources, such as Oxychem, Occidental Chemical Corp., Dallas, Tex. under the trademark "ACL" (chlorinated s-triazine triones) such as "ACL" 90 plus and Olin Corp., Stamford, Conn. under the trademark "CDB" (trichloroisocyanuric acid) like "CDB" 90. Other oxidants may also be used, such as calcium hypochlorite, sodium (like "ACL" 56 or "ACL" 60) or potassium (like "ACL" 59) salts of dichloroisocyanuric acid, dichlorodimethylhydantoin and trichloromelamine. TCCA, bromochlorodimethyl hydantoin available under the tradename "DANTOBROM" and dichlorodimethylhydantoin available under the tradename "DANTOCHLOR" from Lonza Inc., Fairlawn, N.J., are particularly desirable oxidants for use as a cleansing agents in conjunction with the dispensers of this invention.

Other suitable oxidants include peroxides, peroxide precursors and peracids. Suitable peroxides include hydrogen peroxide and calcium peroxide. Calcium peroxide is available from Interox, Houston, Tex., under the trade name "IXPER 75C". Peroxide precursors include sodium perborate monohydrate, sodium perborate tetrahydrate, percarbamide and sodium percarbonate. These compounds are commercially available from Degussa AG, Federal Republic Germany.

Peracids can also be used, but are preferably formed in situ due to instability of the peracid. In situ generation is accomplished by reacting an activator such as tetraacetylethlenediamine ("TAED") with any of the peroxide precursor, such as perborate, percarbonate or percarbamide. TAED based peroxygen bleaching systems are available from Warwick International Limited, Mostyn, Holywell, Clwyd, Wales under the tradename "MYKON A". A commercially available solid peracid includes the magnesium salt of monoperoxyphthalic acid, available from Interox, Houston, Tex., under the tradenames "H48" and "MNPP".

As a fragrance component, any of a plethora of materials may be employed depending on the type of aroma that is to be desirably imparted to the toilet bowl. For instance, pine, green apple, citrus and potpourri represent only a few of the many fragrances that may be desirably employed.

It is desirable for the fragrance component to impart an aroma intensity in the air when delivered at about 1 ppm to the toilet bowl. With such an aroma intensity, it is believed that though a portion of the fragrance component is likely to be flushed down the toilet, the remaining portion should possess a sufficient intensity to impart its aroma as desired to the bath or washroom.

The aroma intensity for laboratory purposes may be determined by purge and trap gas chromatography. Volatile organics ("VOC's") contained in the fragrance component may also be monitored using a photoionization detection such as a Model PI 101 manufactured by HNU Systems. The instrument utilizes a 10.2 eV UV ionization lamp and has a detection range of about 0.1 to 2000 $ppm_v$. Flow rate through the ion chamber of this instrument is approximately 100 cc/min. This instrument draws the air from about 4 to 6 inches from the surface of the water ("head space") and detects VOC's in ppm. For example, sampling the head space of fragranced blocks comprised of 6.0% by weight of Acid Blue 9 powder, 14.0% by weight of fragrance and 80% by weight of sodium alkylaryl sulfonate; provided a photoionization reading of about 0.5 to about 5 ppmv over the life of the composition. Conventional lavatory cleansing block formulas are typically below the detection limits of this instrument.

Many different coloring agents or dyes may also be used in the lavatory cleanser composition. The choice of coloring agent or dye will depend of course on the color desired for the water into which the lavatory cleanser composition is to be dispensed for delivery to the toilet bowl (where it resides during the quiescent periods between flushes). The coloring agents or dyes chosen should be water-soluble to an extent of at least about 0.01% by weight of the total lavatory cleanser composition at a temperature of about 25° C. Coloring agents or dyes which tend to stain porcelain are not preferred.

Examples of suitable coloring agents or dyes include anionic dyes such as Acid Blue 1 and Acid Blue 9.

The amount of coloring agents or dyes to be dispensed into the water will depend on the color intensity desired. The absorbance of the coloring agents or dyes may be determined for laboratory purposes through the use of a visible spectrophotometer, such as a Perkin-Elmer Model 552 spectrophotometer.

Typically, the amount of coloring agents or dyes delivered in the toilet bowl should be sufficient to provide an absorbance in a 1 cm spectrophotometric cell of from about 0.01 absorbance units ("a.u.") to about 0.2 a.u. when measured at its wavelength maxima. Consumers typically believe that colored cleansing product is no longer working at a color intensity below this range.

It may be advantageous to calculate the parts per million ("ppm") of dye delivered to the flush water utilizing Beer's Law. Beer's Law states that the intensity of an emergent ray of light is inversely proportional to the depth of liquid through which it travels. In other words, if absorbance (a.u.) and concentration (ppm) are plotted for a standard dye solution on x and y axes, respectively, a straight line will result. Each dye has its own characteristic slope. The absorbance measurement may be converted into ppm dye delivered by the following equation:

$$\text{Slope} = \frac{\text{Absorbance}}{\text{Concentration}}$$

For example, the slope for Acid Blue 9 is 0.106 a.u./ppm. Thus, the ppm of Acid Blue 9 delivered to the flush water may be calculated by multiplying the absorbance units by a factor of about 9.4.

Typically the coloring agents or dyes serve a dual purpose in the lavatory cleanser compositions of this invention. They provide the toilet water with color that may be perceived as attractive to the consumer. They may also act as an indicator for the consumer that the cleansing agents in the lavatory cleanser composition have been (or are becoming) depleted by providing less color to the water in the toilet bowl. Thus, when a coloring agent or dye is employed in the lavatory cleanser composition, it may be desirable that such be employed in amounts which deplete at substantially the same rate as the lavatory cleansing agents.

The lavatory cleanser compositions of this invention may be used in a solid form, a liquid form or a gel form. Where a solid form is desirable, the lavatory cleanser compositions may be pressed or extruded into a cake or tablet together with known caking or tableting agents, if desired, for use in conjunction with the dispensers as described and depicted herein. The shape of the cake or tablet will of course depend on the design of the receptacle or die that is to receive the composition during processing into the cake or tablet. Such solid shaped cakes or tablets may also be prepared by hydraulic stamping, or by pouring a melt of the lavatory cleanser composition into a mold and thereafter cooling the mold until the composition solidifies.

The lavatory cleansing compositions of the present invention typically deliver surfactants to the toilet bowl at levels between about 0.5 ppm to about 20 ppm, and most preferably from about 1 ppm to about 15 ppm. This delivery effects a lowering of the surface tension of the water delivered to the toilet bowl to between about 50 and 70 dynes/cm at a water temperature of about 25° C.

Where a liquid form or a gel form is desirable, an appropriate amount of water or known gelling agent may be introduced to the lavatory cleanser composition to provide the desired viscosity.

The lavatory cleansing systems and dispensers of this invention may be appreciated further by the description which follows hereinafter, and particularly in view of the figures.

Figure 1B:
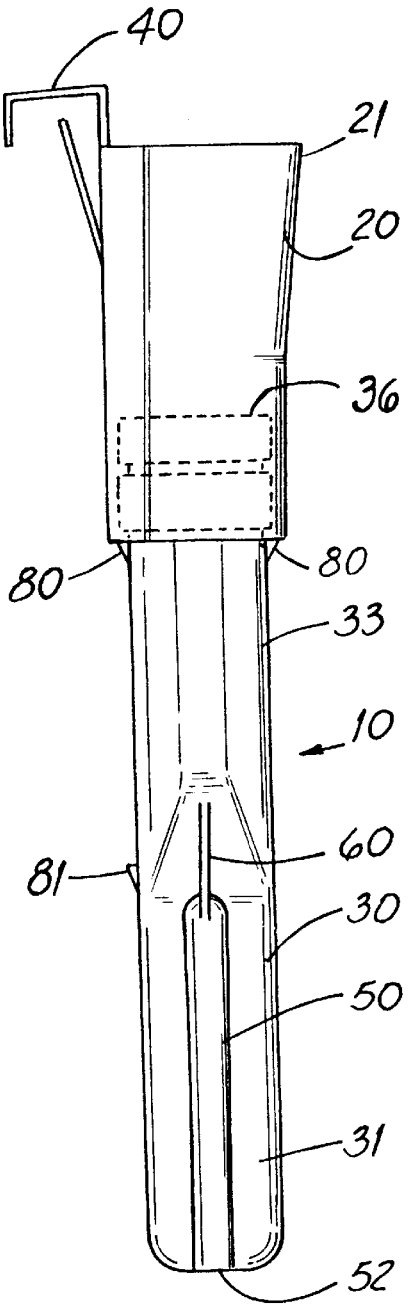
FIG. 1B depicts a side view of a dispenser depicted in FIG. 1A.
Figure 2A:
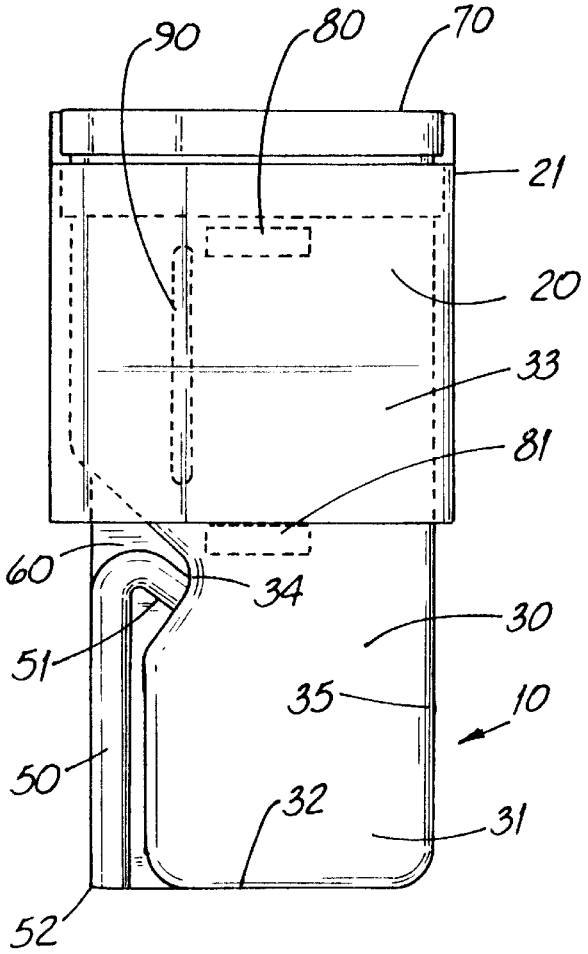
FIG. 2A depicts a frontal view of the dispenser depicted in FIG. 1A in a first collapsed form in which the lower portion of the chamber may be retracted within the upper portion of the chamber.
Figure 2B:
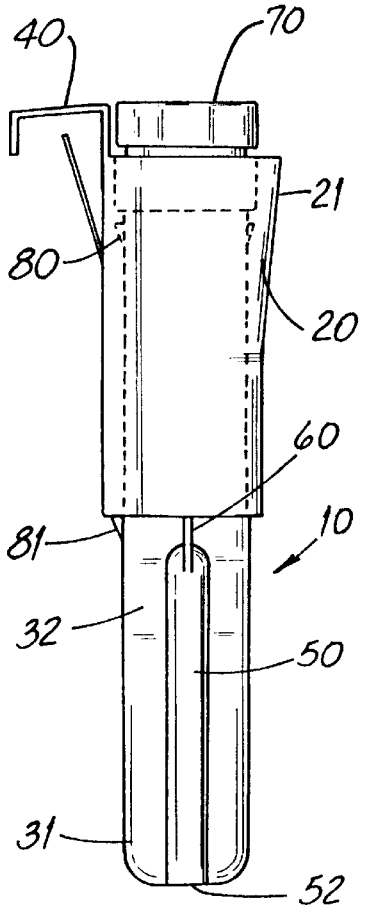
FIG. 2B depicts a side view of the dispenser depicted in FIG. 1B in a the first collapsed form.

With reference to FIGS. 1A and 1B, it may be seen that the dispenser 10 may comprise a chamber 30 having an upper portion 33 and a lower portion 31. The upper portion 33 of chamber 30 is open at its top end 36 so that it is capable of receiving a lavatory cleanser composition. The dispenser 10 may also have an extended portion 20 attached, slidably or fixedly, to the chamber 30. The extended portion 20 of dispenser 10 is also open at its top end 21, and is telescoped, for ready receipt of the lavatory cleanser composition. (See FIGS. 1A, 1B, 2A and 2B.) Additionally, the dispenser 10 may remain in a telescoped position via ramp 80 on which the extended portion 20 rests. The extended portion 20 of dispenser 10 is equipped with a mounting flange 40 for mounting dispenser 10 for use in a toilet tank. With reference to FIGS. 2A and 2B, the extended portion 20 may rest on lower ramp 81 in an untelescoped position.

The dispenser 10 may be from 17.5 cm to about 37.5 cm in length, when in use, and have a width of about 6.0 cm to about 8.0 cm and a depth of about 1.0 cm to about 3.0 cm. In an alternative embodiment, not shown, the dispenser may be mounted by a hanger attached to the dispenser at the top of chamber 30. The attachment may be accomplished by a bayonet arrangement, such that the dispenser does not swing on the hanger during refill operations.

An inlet/outlet means 50 is attached to the chamber 30 of dispenser 10. While the inlet/outlet means 50 may be attached to the chamber 30 of dispenser 10 at any practicable position thereon, preferably it should be attached to the lower portion 31 of the dispenser 10. Most preferably, the inlet/outlet means 50 should be attached above the solid cake to prevent clogging of the inlet/outlet means 50 during the operation of the dispenser. A proximal end 51 of inlet/outlet means 50 is attached to a proximal wall 34 of chamber 30 of dispenser 10 at an opening in chamber 30 of dispenser 10 through which water may pass into dispenser 10 and through which diluted or solubilized lavatory cleanser compositions may exit dispenser 10. Thus, inlet/outlet means 50 is seen to be the conduit by which water enters the dispenser 10 as the toilet tank is refilling and as the diluted or solubilized lavatory cleanser composition exits the dispenser as the toilet is flushed.

As water enters dispenser 10 through inlet/outlet means 50, turbulence is generated in dispenser 10, particularly in the lower portion 31 of chamber 30. This turbulence is increased due to the attachment of the proximal end of inlet/outlet means 50 at a downward angle by the existence of a higher pressure in the toilet tank and a lower pressure in chamber 30. The turbulence so generated assists in diluting or solubilizing the lavatory cleanser composition disposed in the dispenser 10. Each time the toilet is flushed, the chamber and the cake or tablet are washed by the forceful flow of water to accelerate the dissolving of the cake or tablet in the water of chamber 30 and to avoid the establishment of unstirred regions within the water of chamber 30 where water-treating materials might otherwise collect and concentrate. Thus the turbulence creates a consistent delivery, and eventually the total evacuation of the lavatory cleansing composition from the dispenser.

Inlet/outlet means 50 should be attached to chamber 30 at an angle sufficient to allow water entering dispenser 10 to deflect from a particular area on the interior of the distal wall 35 of chamber 30. This angle may vary according to width of the unit to allow the water to deflect from a particular area on the interior of the distal wall 35 of chamber 30. The area on the interior of the distal wall 35 extends from 0 to about 10 cm, preferably from 0 to about 5 cm from the bottom of chamber 30. At such an angle, inlet/outlet means 50 directs the turbulent water to the lavatory cleanser composition. In this way, an appropriate amount of dilution or dissolution of lavatory cleanser composition may be achieved. In addition, when the lavatory cleanser composition is depleted, the turbulence created by the dispenser of the present invention allows for an abrupt end of life of the lavatory cleanser composition so that the consumer knows when to replace the lavatory cleanser composition in dispenser 10.

The amount of turbulence generated by the entering water is influenced by the inside diameter of inlet/outlet means 50 and the distance the incoming water must travel before contacting distal wall 35 of chamber 30 and deflecting therefrom.

Inlet/outlet means 50 itself may be tubular and should extend away from dispenser 10 so that its distal end 52 is positioned lower than its proximal end 51, which proximal end 51 is attached to dispenser 10, preferably at a downward angle.

The flow properties within the dispenser are governed by the inside diameter of the inlet/outlet means 50, the density and the viscosity of the water in the tank, and the rate at which water fills in the toilet tank. More consistent calculations of turbulence and flow properties may be measured within the center of the inlet/outlet means. For example, flow in a circular tube is parabolic, with the maximum flow being at the center of the tube. The maximum turbulence at the center of inlet/outlet means 50, indicated as Reynolds number ("Re"), may be computed using the following formula:

$$\mathrm{Re} = \frac{\rho v d}{\eta}$$

where

ρ=density of fluid v=velocity of fluid ("flow ratio")

d=2r=diameter of tube

η=viscosity of fluid

The following parameters were used in the calculation of Re for the dispenser of the present invention:

density of water at 25° C.=0.997 $g \cdot cm^{-3}$ viscosity of water at 25° C.=0.008904 poise The flow properties in the inlet/outlet means 50, namely a tube, of the present invention were based on the following several assumptions:

First, the filling cycle of the preferred dispenser of the present invention ranged from 10 seconds to 100 seconds. In addition, the entire flush cycle of a 3.5 gallon (13 liter) American standard or Kohler toilet is between 40 and 90 seconds, and only a portion of this time is spent filling the dispenser (the last half of the fill cycle). Accordingly, the flow rate of fluid inlet/outlet means 50 ranges from about 1 ml/s to about 10 ml/s.

The inner diameter of the inlet/outlet tube may range from about 0.159 cm to 1.27 cm (radii of 0.0794 cm to 0.635 cm). Preferably, the inner diameter of the inlet/outlet means 50 is about 0.30 cm to about 1.0 cm (radii of 0.15 cm to 0.5 cm) and most preferably about 0.4 to about 0.7 cm (radii of 0.2 cm to 0.35 cm).

The flow rate of the inlet/outlet means was calculated by the following calculation and the assumption that Poiseulle's flow prevails. Under Poiseulle's flow, the maximum velocity of fluid is assumed to be at the center of inlet/outlet means 50.

The velocity of fluid, in this case water, was calculated using the following equations:

$$\text{Maximum Velocity (at center) (cm/s)} = \frac{2Q}{\pi r^2}$$

$$\text{Average Velocity (cm/s)} = \frac{2Q}{3\pi r^2}$$

where r=radius of the tube

Q=flow rate $$\text{Average Velocity} = \frac{1}{Q}\int_{r=0}^{r} v \cdot dq$$

Preferably, the turbulence in the center of inlet/outlet means 50 is in the range of about 224 Re to about 18,000 Re; more preferably from about 300 Re to about 15,000 Re; and most preferably from about 500 Re to about 10,000 Re.

Inlet/outlet means 50 is secured to chamber 30 of dispenser 10 by securing means 60. Securing means 60 may be a unitary piece, integrated between inlet/outlet means 50 and dispenser 10 or may be multiple pieces whose function is to ensure that the integrity of the positioning of inlet/outlet means 50 with respect to dispenser 10 remain intact. Securing means may be made from the same material as the remaining parts of dispenser (see infra) or other appropriate materials.

In use, the lavatory cleansing compositions of the present invention may be disposed in dispenser 10 so that they reach the lower portion 31 of chamber 30 of dispenser 10. These lavatory cleanser compositions may be disposed in dispenser 10 prior to or after mounting dispenser 10 in the toilet tank. When placing the lavatory cleanser compositions in dispenser 10, care should be taken to ensure that the lavatory cleanser compositions reach the bottom of the chamber 30 of dispenser 10. Accordingly, it is preferable that the upper portion 33 of chamber 30 is wider than the lower portion 31 of chamber 30 to more readily receive the lavatory cleanser composition, which readily enters lower portion 31.

When a solid form of the lavatory cleanser composition is used, there may be a potential for the lavatory cleanser composition to become lodged in the chamber 30 of dispenser 10 before reaching the lower portion 31 thereof when it is being disposed therein. Preferably, guide 90, as shown in FIGS. 1A and 1B may be utilized to reduce the likelihood of the block becoming lodged in chamber 30 before reaching lower portion 31. When in a liquid form, particularly a highly viscous liquid, or in a gel form, the lavatory cleanser compositions may stick to the interior of the chamber 30 of the dispenser 10. Guide 90 may increase the likelihood of the liquid or gel reaching lower portion 31. By ensuring that the lavatory cleanser compositions reach the lower portion 31 of chamber 30, the performance of the lavatory cleansing system (i.e., the lavatory cleanser composition in conjunction with the dispenser) may be enhanced. This is so because the positioning of the lavatory cleanser composition at or near the bottom of the lower portion 31 of chamber 30 of dispenser 10 allows for the generated turbulence to dilute or solubilize the lavatory cleanser composition as it is positioned within the swirling vortex of water. This turbulence enables the dissolved product to flow to the top portion of the dispenser for delivery of product during the next flush. In addition, by ensuring that the lavatory cleanser composition reaches the lower portion 31 of chamber 30, dispenser 10 will not require refilling as frequently, all else remaining the same of course.

After flushing a toilet equipped with a properly mounted dispenser 10, the toilet tank should begin to refill with water, which should also enter dispenser 10 through inlet/outlet means 50. The water should continue to enter the toilet tank until its refill shut-off mechanism is triggered. At this point, the level of water in the toilet tank should be substantially the same as the water now contained in dispenser 10.

As noted above, the turbulence generated from water which enters the chamber 30 of dispenser 10 through inlet/outlet means 50 may vary depending on the width of the inside diameter of inlet/outlet means 50. Inlet/outlet means 50 is preferably tubular with an inside diameter within the range of from about 0.159 cm to about 1.27 cm, with about 0.30 cm to about 1.0 cm being desirable, and about 0.4 cm to about 0.70 cm being most desirable. The inside diameter of inlet/outlet means 50 may be substantially consistent throughout. Alternatively, the inside diameter of the distal end 52 of inlet/outlet means 50 may be larger than the inside diameter of the proximal end 51 of inlet/outlet means 50, or vice versa.

In addition, inlet/outlet means 50 should also be attached to chamber 30 to form an upward angle as inlet/outlet means 50 extends away from the point of attachment on chamber 30. More precisely, in route from the proximal end 51 of inlet/outlet means 50 to distal end 52 of inlet/outlet means 50, inlet/outlet means 50 should turn slightly upward toward extended portion 20 and then extend downward toward the bottom region 32 of lower portion 31 of chamber 30. This angular or serpentine nature of inlet/outlet means 50 assists in generating the proper amount of turbulence from water which enters chamber 30. This turbulence allows for the substantial evacuation of the lavatory cleanser composition by avoiding unstirred regions within the water in the chamber where the lavatory cleanser composition might otherwise collect and concentrate. This translates to an abrupt end of life of the lavatory cleanser composition so the consumer knows the appropriate time to refill the dispenser. The turbulence also assists accelerating the dissolution of the cleanser composition as well as in pushing the dissolved material up to the top of the chamber to ensure consistent delivery during the next flush. The angle of the point of attachment of the proximal end 51 of inlet/outlet means 50 and chamber 30 may vary to allow the water to deflect from inner distal wall of chamber 30 at a position within the range of from 0 to about 5 cm from the bottom of chamber 30, with about 1.0 cm to about 2.0 cm from the bottom of the chamber being more desirable. Of course, the generation of the proper amount of water turbulence within chamber 30 is assisted by the width of the inside diameter of inlet/outlet means 50 in combination with the angle formed at the point of attachment of the proximal end 51 of inlet/outlet means 50 and the dimensions of chamber 30 that assist in generating a proper amount of water turbulence within chamber 30. With that in mind, the inside diameter of inlet/outlet means 50 is preferably from about 0.3 cm to about 1.0 cm, and the dimensions of chamber 30, particularly the lower portion 31 of chamber 30, should be about 6 cm in length, about 6 cm in width and about 2.5 cm in depth, when in a three-dimensional rectangular-type arrangement.

The turbulence generated from the water entering dispenser 10 assists in diluting or solubilizing the lavatory cleanser composition disposed at or near the bottom region 32 of lower portion 31 of chamber 30. It is in this bottom region 32 where the lavatory cleanser composition is diluted or solubilized to an appropriate concentration. By virtue of the water which enters dispenser 10, the diluted or solubilized lavatory cleanser composition elevates within chamber 30 of dispenser 10 from the lower portion 31 to the upper portion 33 to a point above inlet/outlet means 50. The point at which the diluted or solubilized lavatory cleanser composition ceases to elevate further within the dispenser 10 is at substantially the same level as the water which fills the toilet tank. With the diluted or solubilized lavatory cleanser composition now located in the upper portion 33 of chamber 30 of dispenser 10, upon flushing the toilet, the diluted or solubilized lavatory cleanser composition is dispensed from the upper portion 33 of chamber 30 of dispenser 10 through inlet/outlet means 50 and into the flush water of the toilet tank which is delivered to the toilet bowl. This turbulence translates to a demonstrable difference in the delivery of lavatory cleanser to the toilet by the cleansing system of the present invention.

It has been observed with known lavatory dispensers and solid cleansing blocks that after having been in the quiescent period between flushes for prolonged periods of time (e.g., about 2–10 hours), the initial flush of the toilet may deliver a very concentrated amount of the lavatory cleanser composition, and repetitive or frequent successive flushes of the toilet provide a less concentrated amount of the lavatory cleanser. This is in contrast to the present invention, where, after having been in the quiescent period between flushes for prolonged periods of time, the initial flush of the toilet contains a fairly dilute amount of the lavatory cleanser. However, after repeated or frequent successive flushes of the toilet, a more concentrated amount of the diluted or solubilized lavatory cleanser composition should be provided.

In addition, because of the dilution or dissolution of the lavatory cleanser composition in the lower portion 31 of chamber 30 of dispenser 10, after each flush a residual volume of the diluted or solubilized lavatory cleanser composition remains in the lower portion 31 of chamber 30. That is, water in this lower portion 31 remains in contact with the lavatory cleanser composition between flushes of the toilet, thereby forming a more concentrated amount of the lavatory cleanser composition within the dispenser 10. The higher concentration is due at least in Ipart to the high solubility of the components of the lavatory cleanser composition (save the fragrance component) in water. This residual volume becomes saturated with product rapidly, and then the composition stops dissolving at the saturation point. This residual volume is believed to lend consistency to the dispensing and delivery of the lavatory cleanser composition when the toilet is flushed frequently or repetitively.

If the delivery of a greater amount of product to the flush water is desired during the initial portion of the life of the lavatory cleanser product, the product may extend from about 1.0 cm to about 2.5 cm above inlet/outlet means 50. Care must be taken that the product does not clog inlet/outlet means 50 upon dissolution.

In use the lavatory cleanser composition, particularly when in solid form, becomes diluted or solubilized in stages, with that portion of the lavatory cleanser composition exposed to the entering water becoming diluted or solubilized. Preferably, as the lavatory cleanser disposed at the bottom region 32 of the lower portion 31 of chamber 30 becomes diluted or softens, it substantially fills the interior contours of the bottom region 32. Accordingly, the delivery of cleanser is more consistent as the composition is delivered from a constant surface area over the life of the composition. In contrast, as a conventional lavatory cleansing block dissolves, the block delivers materials from a diminishing surface area over its effective life.

It may be desirable to prepare a lavatory cleanser composition for use in dispenser 10 that contains different colors or fragrances. Since the lavatory cleanser composition becomes diluted or solubilized from the portion of the lavatory cleanser composition exposed to the entering water, different colors or fragrances may be imparted to the water as desired with a consistent control of the layers of the lavatory cleanser composition. This may be most readily accomplished by preparing a lavatory cleanser composition in a solid form so that distinct color and/or fragrance layers may be generated.

Another aspect of this invention provides a dispenser with more than one chamber and an inlet/outlet means for each chamber. In this way, different components of the lavatory cleanser composition may be disposed in separate chambers. This would minimize or effectively eliminate the compositional mixing necessary in formulating the lavatory cleanser compositions by dispensing and delivering individual components or combinations thereof from separate chambers and inlet/outlet means.

The dispensers of this invention may be manufactured from a variety of materials. The materials should however be readily processable, and once processed, the materials should be resilient and, withstand changes in water temperature and water turbulence created within the dispenser or in the toilet tank itself. The materials for fabricating the dispenser should also be inert to water as well as inert to components of the lavatory cleanser composition. Suitable materials include PVC, HDPE, LDPE and PET. These materials may be used to fabricate dispensers utilizing a variety of manufacturing processes including injection molding, thermoforming and blow molding.

The dispenser depicted in FIGS. 1A and 1B may be manufactured for retailer and consumer convenience in a collapsible form so that the chamber 30 may be retractable within an extended portion 20 of the upper portion 33 of the chamber 30 of the dispenser 10. (See FIGS. 2A and 2B.) Alternatively, the upper portion 33 of the dispenser 10 may be retractable within the chamber 30. In either instance, the dispenser 10 may be packaged in smaller dimensions (e.g., about 18 cm) thereby using less shelf-space and using less packaging material, which is pleasing to environmental concerns.

The refillability of the dispenser allows for replenishing or recharging of the dispenser, without removing it from the toilet tank when the lavatory cleanser composition has been depleted. In addition, this aspect of the present invention allows the dispenser to be refilled, whether removed from the toilet tank or not, rather than discarded when the lavatory cleanser composition has been depleted. This is also pleasing to environmental concerns because the number of discarded dispensers would be reduced.

Figure 3:
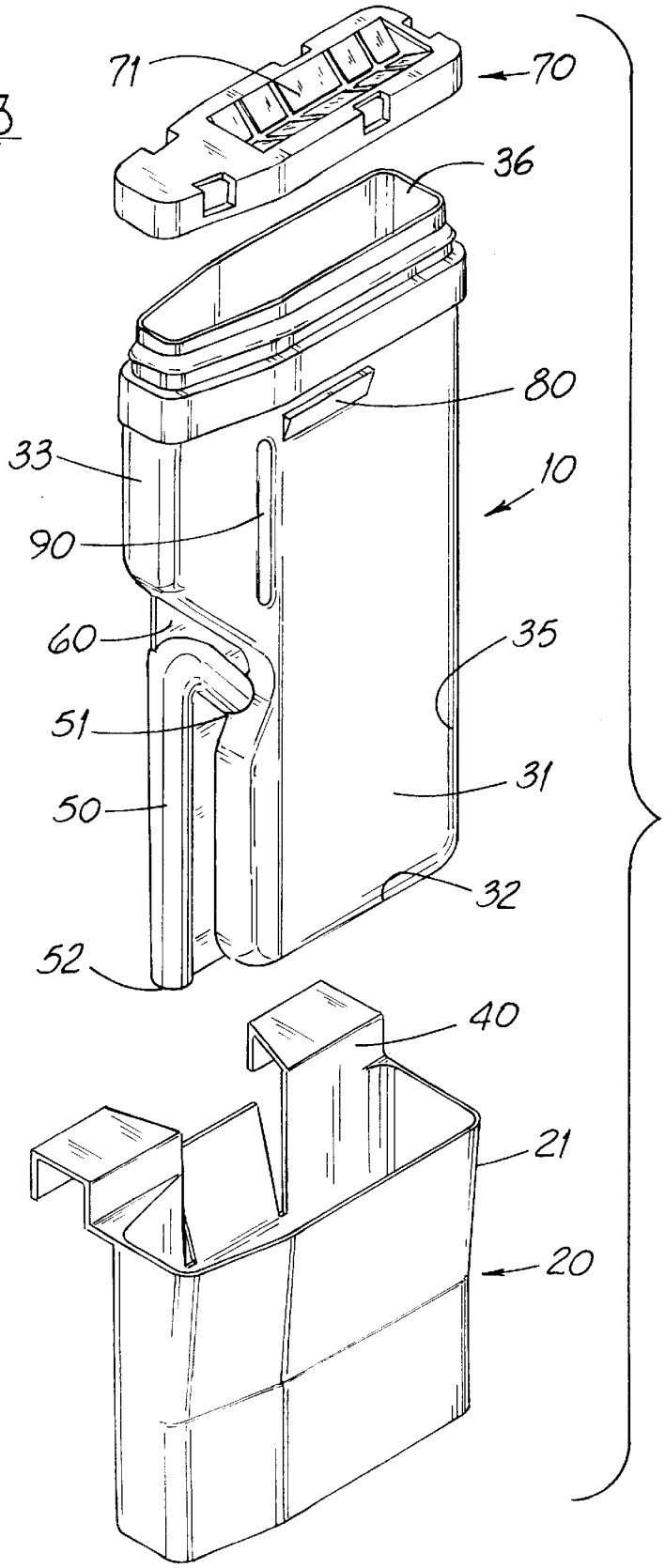
FIG. 3 depicts an exploded perspective view of a dispenser of this invention with a retaining means positioned between a chamber of the dispenser capable of containing a lavatory cleanser composition disposed therein and an extended portion of the dispenser.
Figure 4:
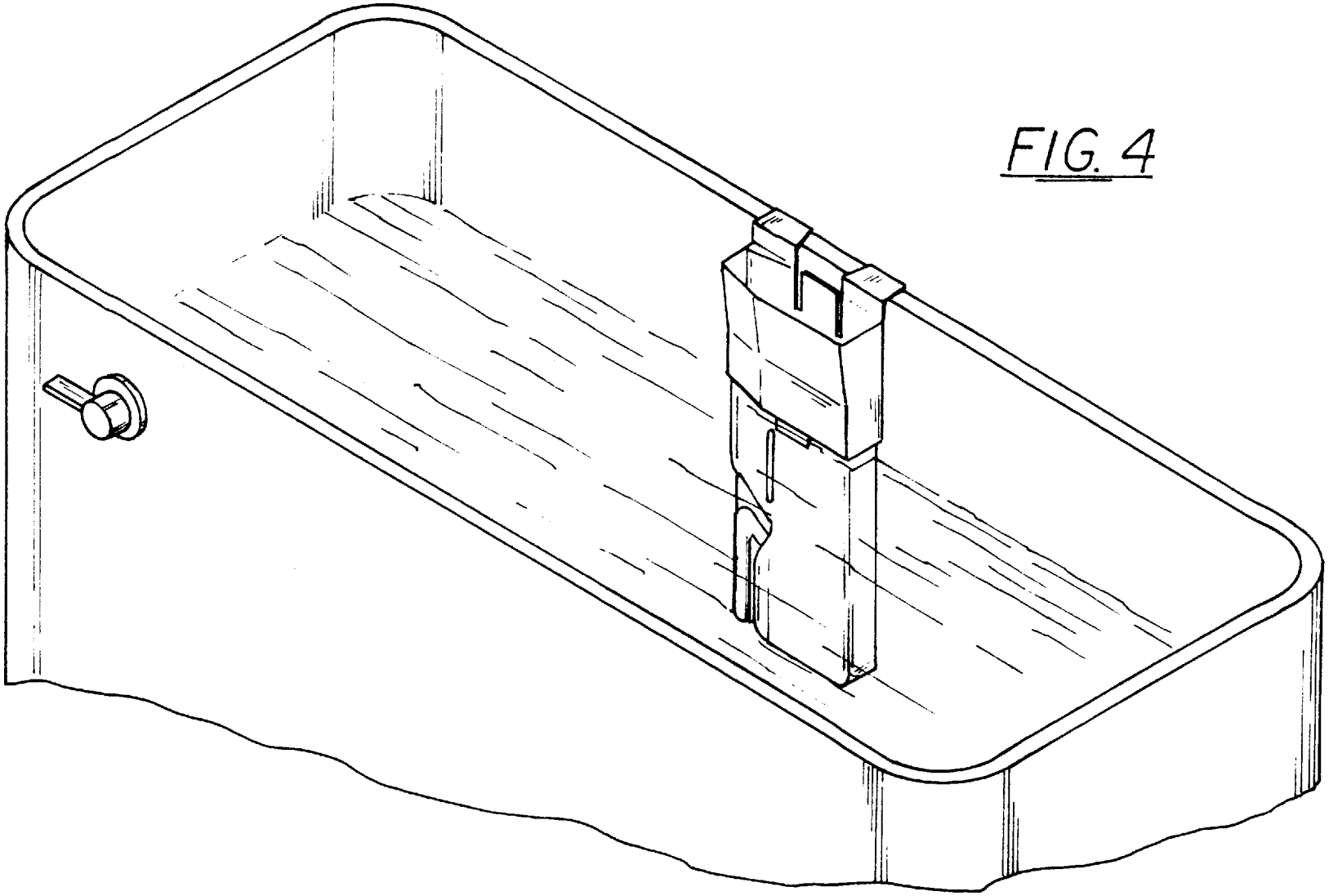
FIG. 4 depicts a dispenser of this invention mounted in a toilet tank.
Figure 5:
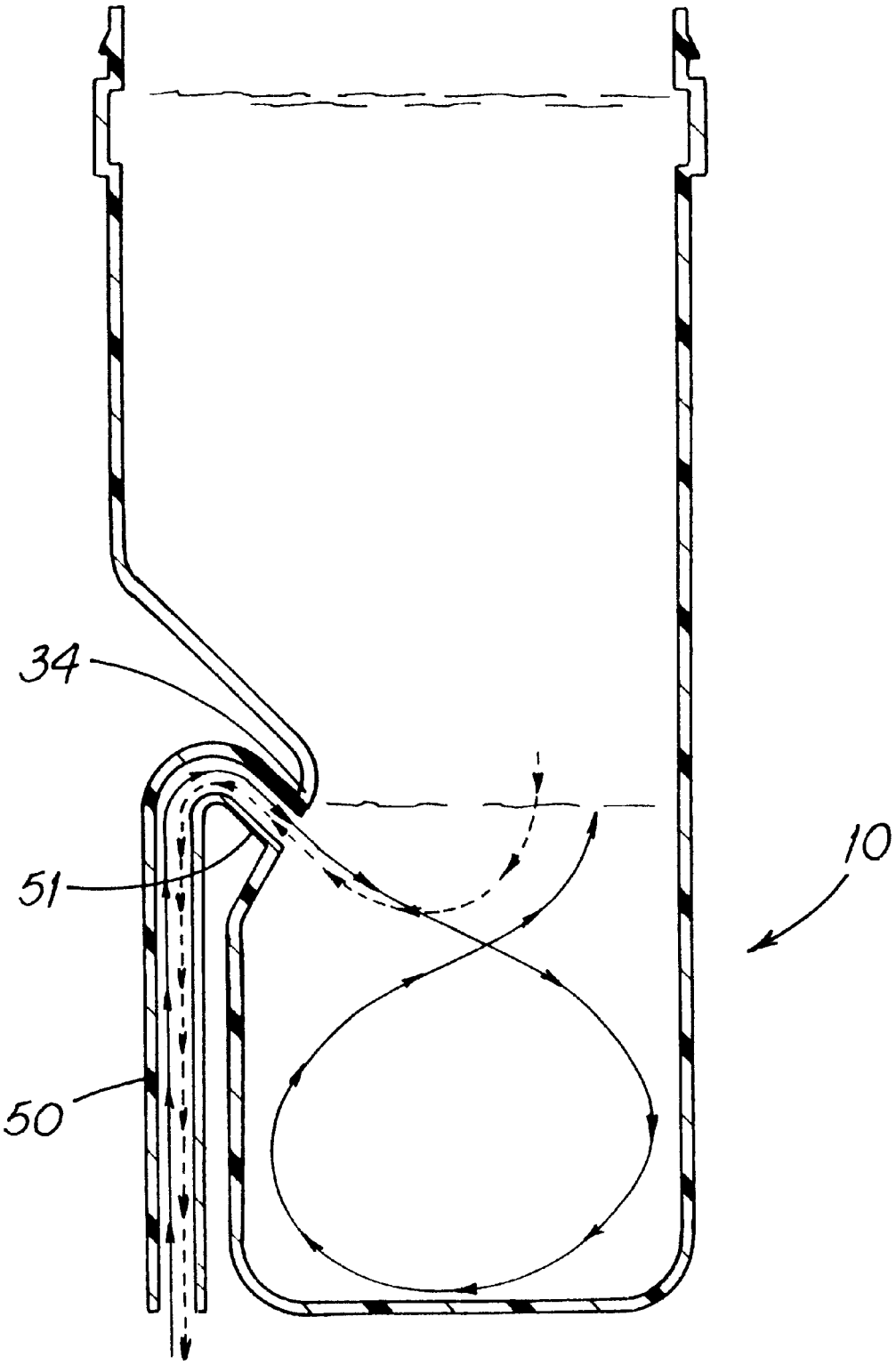
FIG. 5 is a diagram which depicts the flow of water into a dispenser of this invention through an inlet/outlet means (solid lines) as the level of the water in the toilet tank in which the dispenser has been mounted rises after flushing and the flow of diluted or solubilized lavatory cleanser composition out of the dispenser through the inlet/outlet means (broken lines) for delivery to the toilet as the level of the water in the toilet tank descends as the toilet is flushed.
Figure 6:
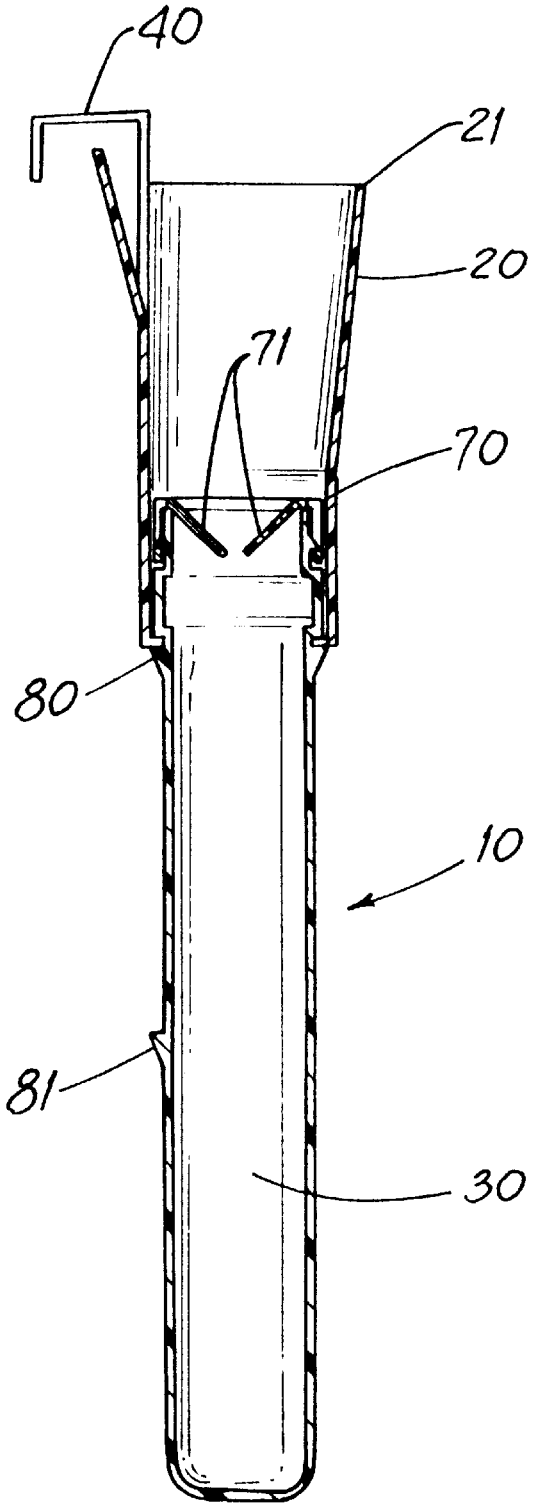
FIG. 6 depicts a cross section of the dispenser depicted in FIG. 1A taken along the line 6—6.

In another aspect of the present invention, it may be desirable to prevent unintentional access to the interior of chamber 30 of dispenser 10. This is particularly so when the lavatory cleanser compositions contain an oxidant or other component known to carry certain dangers when handled. In such instances, a retaining means 70 may be positioned between the upper portion 33 of chamber 30 and the extended portion 20 of dispenser 10. With reference to FIG. 3, it may be seen that retaining means 70 is dimensioned and disposed to fit over the upper portion 33 of chamber 30 of dispenser 10 and to allow the extended portion 20 of dispenser 10 to fit thereover. Preferably, retaining means 70 has interlocking fingers 71. A similarly dimensioned and configured retaining means (not shown) could also be located at the top end 21 of extended portion 20 of dispenser 10.

While the present invention has been amply described in terms of a dispenser capable of mounting in a toilet tank, the dispenser of the present invention is also well-suited for mounting in any liquid containing vessel in which the level of water may change from a higher level to a lower level and vice versa, where at the lower level it may be desirable for the dispenser to deliver a volume of water-treating material with an enhanced consistency of concentration from delivery to delivery. Examples of such water-containing vessels include swimming pools where oxidants or other water-treating materials may be desirably delivered to the water when the lower level is reached and aquariums where nutrients or other water treatments may also be desirably delivered to the water when the lower level is reached.

The following examples are provided to illustrate the utility of the present invention and are not to be construed so as to limit in any way the teaching herein.

EXAMPLES

Example 1

In this example, we compared the concentration consistency of the amount of active ingredients delivered from a lavatory cleansing system of this invention to a conventional lavatory cleansing block.

A lavatory cleanser composition of this invention was prepared by extruding the following components together into blue-colored, fragranced blocks:

| Component | Percentage |
|---|---|
| Sodium Alkylaryl Sulfonate † | 84.5 |
| Fragrance Component | 10 |
| Acid Blue #9 (Dye) | 5.5 |
| † Anionic Surfactant; NANSA HS 85/5 | |

The extruded lavatory cleanser block used in this example weighed about 22.8 g.

The dispenser used in this example was one having substantially the same shape and features as that shown in FIGS. 1A and 1B, except that it was not collapsible.

The dispenser was mounted in a 3.5 gallon (13 liter) toilet tank and the blue-colored fragranced lavatory cleanser block was disposed therein and allowed to reach the bottom of the dispenser.

In another toilet, a conventional lavatory cleansing block whose formula is sodium alkylaryl sulfonate, 85% active (anionic surfactant)—60%; hydroxyethyl cellulose (binder)—10%, Borax·5 mole $H_2O$ (filler/salt)—16%, Acid Blue #9—4% and fragrance component—10% was placed in the toilet tank. The conventional lavatory cleansing block used in this example weighed about 24.86 g.

To examine the delivery consistency of the lavatory cleansing system of this invention and compare it to a conventional lavatory cleansing block, the respective toilets in which each was placed were flushed 10 times a day for 3 days prior to taking the first reading. After the third day, the respective toilets were flushed repetitively in 0.5 hour intervals. The instrumental observations from this comparison were made using a Perkin-Elmer Model 552 spectrophotometer set at 628 nm using a 1 cm cell, and are shown in Table 1 below:

TABLE 1

| | Absorbance After Each Flush (× 100) | |
|---|---|---|
| Flush No. | LCS[1/] | Conventional Lavatory Cleanser |
| 1 | 8.2 | 4.2 |
| 2 | 12.6 | 1.9 |
| 3 | 6.8 | 0.6 |
| 4 | 4.9 | 0.3 |
| 5 | 3.6 | 0.0 |
| 6 | 2.0 | 0.1 |
| 7 | 1.7 | 0.1 |
| 8 | 1.2 | 0.1 |
| 9 | 1.0 | 0.1 |
| 10 | 0.7 | 0.1 |

[1/]Lavatory cleansing system of this invention

It is seen from this data that the lavatory cleansing system of the present invention delivers a more concentrated amount of coloring agent than the conventional lavatory cleansing block and delivers a more concentrated and consistent amount after repetitive or successive flushes. Since the lavatory cleanser composition and the conventional lavatory cleansing blocks are formulated so that the degree of color intensity imparted to the toilet water will be limited to a concentration of lavatory cleansing agent, this data demonstrates that the lavatory cleansing system consistently delivers a more concentrate and consistent amount of lavatory cleansing agent than the conventional lavatory cleansing block. This table also demonstrates that our lavatory cleansing system delivered a higher amount of lavatory cleansing agent to the toilet bowl from the second flush than the first.

In addition, this lavatory cleanser composition was dispensed in separate dispensers mounted in individual toilet tanks at four different weights to determine how many flushes would be required to consume each in the dispenser. The results of that determination are shown in Table 2 below:

TABLE 2

| Weight of Sample (Grams) | Number of Flushes To Consume Sample |
|---|---|
| 1 | 15–16 |
| 2 | 17–20 |
| 5 | 30–32 |
| 10 | 50–60 |

From this information and an average of 10 toilet flushes per day, a lavatory cleanser composition of this formulation may be prepared in an appropriate weight to provide a desired effective "in-use" life span.

Example 2

The purpose of this example is to demonstrate the value of properly formulating the lavatory cleanser composition for use in the dispenser of the present invention. Accordingly, we compared the delivery of lavatory cleanser over a seven day period of a lavatory cleansing system of this invention to that of the conventional lavatory cleansing block as described in Example 1 and a conventional liquid cleanser, each of which being disposed in a separate dispenser. The amount employed of each cleanser—LCS, block and liquid—was chosen so that 0.5 g of the dye would be present.

A. Lavatory Cleansing Composition

An extruded lavatory cleanser block as described in Example 1 was used in this Example. The extruded block weighed about 9.1 g.

The dispensers used in this example were ones having substantially the same shape and features as that shown in FIGS. 1A and 1B, except those they were not collapsible.

The first dispenser was mounted in a toilet tank and the blue-colored, fragranced lavatory cleanser block was disposed therein and allowed to reach the bottom of the dispenser.

The lavatory cleansing system was observed over a seven day period in which the toilet was flushed ten times a day with a quiescent period from midnight to 8 am. Immediately after installation of the dispenser in the toilet on the first day, the toilets were flushed twice (0.5 hour interval) and spectrophotometric measurements taken. On subsequent days, the toilets were flushed at 0.5 hour intervals immediately following the 8 hour quiescent periods. After each flush, a spectrophotometric measurement was made based upon the amount of color in the toilet bowl using a Perkin-Elmer Model 552 spectrophotomer. The results are presented in Table 3 below:

TABLE 3

| | Absorbance After Each Flush (× 100) | | | | |
|---|---|---|---|---|---|
| Flush | Day 1 | 2 | 5 | 6 | 7 |
| 1 | 3.4 | 4.2 | 3.9 | 3.0 | 2.9 |
| 2 | 3.7 | 8.8 | 5.6 | 5.4 | 4.7 |
| 3 | * | 8.2 | 4.0 | 4.5 | 4.2 |
| 4 | * | 5.2 | 2.8 | 3.7 | 3.1 |
| 5 | * | 6.5 | 3.9 | 4.5 | * |

*Not measured

B. Conventional Lavatory Cleansing Block

In a second toilet, a conventional lavatory cleansing block as described in Example 1 was placed in a dispenser of this invention, mounted in the toilet tank. The conventional lavatory cleansing block used in this example weighed about 12.5 g.

The lavatory cleansing system was observed over a seven day period in which the toilet was flushed ten times per day with a quiescent period from midnight to 8 am. Immediately after installation (day one) the toilet was flushed twice (0.5 hour interval) and spectrophotometric measurements taken. On subsequent days, the toilets were flushed at 0.5 hour intervals immediately following the 8 hour quiescent period. The spectrophotometric measurements were made based upon the amount of color in the toilet bowl using a Perkin-Elmer Model 522 spectrophotometer using a 1 cm cell. The results are presented in Table 4 below:

TABLE 4

| | Absorbance After Each Flush (× 100) | | | | |
|---|---|---|---|---|---|
| Flush | Day 1 | 2 | 5 | 6 | 7 |
| 1 | 0.1 | 2.0 | 0.5 | 0.3 | 0.3 |
| 2 | 2.1 | 5.5 | 2.0 | 1.3 | 0.5 |
| 3 | * | 4.1 | 1.3 | 1.0 | 0.3 |
| 4 | * | 2.4 | 1.6 | 0.7 | 0.1 |
| 5 | * | 3.1 | 0.3 | 0.9 | * |

*Not measured

C. Conventional Liquid Cleanser

In a third toilet, a 50 g sample of a conventional automatic liquid cleanser having the following formula: 5% sodium alpha-olefin sulfonate (40% liquid), 2% Acid Blue #9 (50% liquid) and 93% water was placed in a dispenser of this invention and mounted in a third toilet tank.

With the liquid formula, only a two day period was necessary for observation because no product remained in the dispenser after the second day. The toilet was flushed at the same intervals, as the other two in this example, with the results presented in Table 5 below:

TABLE 5

| | Absorbance After Each Flush (× 100) | |
|---|---|---|
| Flush | Day 1 | 2 |
| 1 | 27.2 | 4.9 |
| 2 | 30.2 | 3.5 |
| 3 | | 2.0 |
| 4 | | 1.1 |
| 5 | | 0.2 |

Because of the difference in the degrees of water solubility among the lavatory cleanser composition, the conventional lavatory cleansing block and the conventional liquid cleanser, it is seen that the conventional liquid cleanser is consumed in less than three days thus providing no further cleansing ability. It is also seen that the conventional lavatory cleansing block provides inconsistent delivery of lavatory cleanser and fails to maintain a desirable amount of cleansing ability when the toilet is flushed repetitively. In contrast, the lavatory cleansing compositions of this invention provide a consistent and more concentrated delivery of lavatory cleanser when the toilet is flushed repetitively.

Example 3

In this example, bleach lavatory cleanser compositions were tableted in the form of blocks from 99.5% of TCCA, specifically "CDB-90" and 0.5% magnesium sterate. This lavatory cleanser block was placed in a dispenser as shown in FIGS 1A–2B and mounted in an American standard toilet tank (3.5 gallon/13 liters). This block weighed about 40.0 g at the initiation of this example.

The toilet was flushed 10 times per day over the course of 92 days. The toilet was flushed three times in the morning (with a repeated flush ("second flush") after the "first flush" of the day), twice in the afternoon and five times in the evening, each of which except the second flush, was at one hour time intervals. "First flush" indicates the first flush after a quiescent period of about 2 to 10 hours.

The available chlorine delivered to the toilet bowl was determined by potentiometric titration using thiosulfate as a titrant. In addition, as this lavatory cleanser composition maintained its integrity throughout its life, it was weighed to determine the amount of product remaining during the course of the experiment. The results are presented in Table 7 below:

TABLE 7

| Day | Weight, g | First Flush Available Chlorine (ppm) | Second Flush Available Chlorine (ppm) |
|---|---|---|---|
| 0 | 40.0 | — | — |
| 3 | 43.6 | 2.9 | — |
| 10 | 41.2 | 2.9 | 3.2 |
| 17 | 39.4 | 2.9 | 3.7 |
| 25 | 36.2 | 2.8 | 3.8 |
| 36 | 32.6 | 11.7 | 7.8 |
| 45 | 29.1 | 2.9 | 4.0 |
| 55 | 23.6 | 2.7 | 4.0 |
| 70 | 15.3 | 4.5 | 5.1 |
| 76 | 11.9 | 4.1 | 4.7 |
| 92 | 4.0 | 3.1 | 3.5 |

As shown in Table 7, after 92 days (920 flushes), the tablet lost 36 g or 0.04 g/flush for an average rate of solubility. The above table also indicates the consistency of chlorine delivery over a 3 month period. (Please note that the higher availability of chlorine in day 36 was believed to be caused by the presence of warm water in the toilet tank, thus, this data point is not representative of the consistency of delivery of the present invention). This table also shows that a consistently higher amount of available chlorine was delivered to the toilet bowl from the second flush than the first flush. Typical conventional bleach blocks of 100 g will usually deliver between 8–10 ppm of chlorine after a 10 hour quiescent period during the first two weeks of use and between 2–4 ppm of chlorine during the last weeks of their life, their life being about 4 months.

Example 4

In this example, the consistency of the delivery of coloring agents to the flush water lavatory dispensing systems of the present invention after consecutive flushing was compared with a conventional formula.

A lavatory cleanser composition of this invention was prepared by extruding the following components together into blue-colored, fragranced blocks:

| Component | Percentage |
|---|---|
| Sodium alkylaryl sulfonate ‡ | 60 |
| Sodium Sulfate | 14 |
| Pine Oil | 6 |
| Acid Blue 9 Powder | 20 |

‡ Anionic Surfactant; Ufaryl DL 85

About 49.0 g of the lavatory cleaner composition was placed into a dispenser of the present invention positioned in the tank of an American standard toilet. The toilet was flushed 10 times a day over a 35 day period. The toilet was flushed three times in the morning as described in Example 4. Sampling from the solution in the toilet bowl was performed immediately prior to and after the 8 a.m. flush, and three more times between 8 and 9 a.m. flush, approximately once a week over a 35 day period.

The same sampling as disclosed above was performed with 2000 Flushes (Blue) from Block Drug having 100 g of solid cleansing product.

The absorbance of the lavatory cleaner composition and 2000 Flushes samples was measured at a wavelength of 628 nm in a 1 cm cell, using a Perkin-Elmer model 552 spectrophotometer. The results are presented in Table 8 below:

TABLE 8

| Day | Pre 8 am Flush | Flush 1 | Flush 2 | Flush 3 | Flush 4 |
|---|---|---|---|---|---|
| LCS (49 g Sample) | | | | | |
| 2 | 0.077 | 0.172 | 0.155 | 0.146 | 0.070 |
| 14 | 0.023 | 0.039 | 0.101 | 0.061 | 0.026 |
| 18 | 0.021 | 0.038 | 0.118 | 0.067 | 0.027 |
| 28 | 0.025 | 0.046 | 0.066 | 0.034 | 0.026 |
| 35 | 0.042 | 0.075 | 0.182 | 0.119 | 0.065 |
| 2000 Flushes Blue (100 g sample) | | | | | |
| 2 | 0.008 | 0.068 | 0.022 | 0.004 | 0.000 |
| 14 | 0.003 | 0.053 | 0.019 | 0.007 | 0.002 |
| 18 | 0.005 | 0.071 | 0.024 | 0.008 | 0.004 |
| 28 | 0.006 | 0.032 | 0.012 | 0.008 | 0.003 |
| 35 | 0.003 | 0.084 | 0.033 | 0.007 | 0.003 |

The above results indicate that the lavatory cleansing system of the present invention more consistently delivers color intensities above 0.01 a.u. than the 2000 Flushes (Blue) cleansing block.

What is claimed is:

1. A lavatory cleansing system comprising:

(a) a dispenser adapted for mounting in a toilet tank, said dispenser comprising:

(i) a chamber, the chamber having a lower portion closed at its bottom end and proximal and distal side walls extending from the bottom end, and an upper portion open at its top end, the top end capable of receiving a lavatory cleanser composition, and (ii) inlet/outlet means, the inlet/outlet means comprising a conduit attached to the proximal side wall of the lower portion of the chamber, the conduit having a proximal end and a distal end, the distal end being adjacent the bottom end of the lower portion of the chamber and the proximal end being positioned above the distal end and opening downward at an angle into the lower portion of the chamber, the chamber being in fluid communication with water in the toilet tank through the inlet/outlet means, and (b) a lavatory cleanser composition disposed within the lower portion of the chamber, wherein, after flushing the toilet, water is caused to enter the distal end of the inlet/outlet means, be discharged from the proximal end at turbulent flow and be deflected off the distal side wall of the lower portion of the chamber, thereby assisting in the dilution or dissolution of the lavatory cleanser composition disposed in the lower portion of the chamber which, as the water level in the toilet tank rises, fills a portion of the upper portion of the chamber with diluted or solubilized lavatory cleanser composition and, when the toilet is being flushed, dispensing into the toilet tank through the inlet/outlet means for delivery to the toilet bowl substantially all of the diluted or solubilized portion of the lavatory cleanser composition located in the upper portion of the chamber.

2. The lavatory cleansing system according to claim 1, wherein the lower portion of the chamber may be retracted within the upper portion of the chamber.

3. The lavatory cleansing system according to claim 1, wherein the lavatory cleanser composition is an oxidant selected from the group consisting of trichloroisocyanuric acid, chlorinated s-triazine triones, sodium dichloroisocyanurate dihydrate, calcium hypochlorite, bromochlorodimethylhydantoin, dichlorodimethylhydantoin, trichloromelamine, odium perborate monohydrate, sodium perborate tetrahydrate, calcium peroxide, zinc peroxide, percarbamide, and sodium percarbonate.

4. The lavatory cleansing system according to claim 1, wherein the chamber has an extended portion, and further comprising retaining means, positioned between the upper portion and the extended portion, for preventing unintentional access into the chamber.

5. The lavatory cleansing system according to claim 1, wherein the lavatory cleanser composition comprises:

(i) at least one cleansing agent;

(ii) a fragrance component; and (iii) a dye.

6. The lavatory cleansing system according to claim 5, wherein the lavatory cleanser composition further comprises a bleaching agent.

7. The lavatory cleansing system according to claim 5, wherein the cleansing agent is a surfactant.

8. The lavatory cleansing system according to claim 7, wherein the surfactant is an anionic surfactant which may be combined with a nonionic surfactant with a hydrophobic/lipophobic balance within the range of about 12 to about 25, an amphoteric surfactant or combinations thereof.

9. The lavatory cleansing system according to claim 1, wherein the inside dimension of the inlet/outlet means is sized such that water which enters the chamber through the inlet/outlet means generates turbulence within the center of the inlet/outlet means having a maximum Reynold's number within the range of between about Re 224 and about Re 18,000.

10. A dispenser, adapted for mounting in a tank of a toilet, which is capable of dispensing a conserved amount of diluted or solubilized lavatory cleanser composition by controlling the rate at which water from the toilet tank enters said dispenser, said dispenser comprising:

(a) at least one chamber, the chamber having a lower portion closed at its bottom end and proximal and distal side walls extending from the bottom end, and an upper portion open at its top end, the top end capable of receiving a lavatory cleanser composition, and (b) at least one inlet/outlet means, the inlet/outlet means comprising a conduit attached to the proximal side wall of the lower portion of the chamber, the conduit having a proximal end and a distal end, the distal end being adjacent the bottom end of the lower portion of the chamber and the proximal end being positioned above the distal end and opening downward at an angle into the lower portion of the chamber, the chamber being in fluid communication with water in the toilet tank through the inlet/outlet means which allows for entry of the water into the dispenser after flushing the toilet, wherein, after flushing the toilet, water is caused to enter the distal end of the inlet/outlet means, be discharged from the proximal end at turbulent flow and be deflected off the distal side wall of the lower portion of the chamber, thereby assisting in the dilution or dissolution of the lavatory cleanser composition which is being dispensed.

11. The dispenser according to claim 10, wherein the lower portion of the chamber is retractable within the upper portion.

12. The dispenser according to claim 10, wherein the lavatory cleanser composition comprises:

(i) at least one cleansing agent;

(ii) a fragrance component; and (iii) a dye.

13. The dispenser according to claim 12, wherein the lavatory cleanser composition further comprises a bleaching agent.

14. The dispenser according to claim 12, wherein the cleansing agent is a surfactant.

15. The dispenser according to claim 14, wherein the surfactant is an anionic surfactant which may be combined with a nonionic surfactant with a hydrophobic/lipophobic balance within the range of about 12 to about 25, an amphoteric surfactant or combinations thereof.

16. The dispenser according to claim 10, wherein the lavatory cleanser composition is an oxidant selected from the group consisting of trichloroisocyanuric acid, chlorinated s-triazine triones, sodium dichloroisocyanurate dihydrate, calcium hypochlorite, bromochlorodimethylhydantoin, dichlorodimethylhydantoin, trichloromelamine, odium perborate monohydrate, sodium perborate tetrahydrate, calcium peroxide, zinc peroxide, percarbamide, and sodium percarbonate.

17. The dispenser according to claim 10, wherein the inside dimension of the inlet/outlet means is sized such that water which enters the,chamber through the inlet/outlet means generates turbulence within the center of the inlet/outlet means having a maximum Reynold's number within the range of between about Re 224 and about Re 18,000.

18. A dispensers, adapted for mounting in a liquid containing vessel, which is capable of dispensing a conserved amount of diluted or solubilized material by controlling the rate at which liquid from the vessel enters said dispenser, said dispenser comprising:

(a) at least one chamber, the chamber having a lower portion closed at its bottom end and proximal and distal side walls extending from the bottom end, and an upper portion open at its top end, the top end capable of receiving material to be dispensed, and (b) at least one inlet/outlet means, the inlet/outlet means comprising a conduit attached to the proximal side wall of the lower portion of the chamber, the conduit having a proximal end and a distal end, the distal end being adjacent the bottom end of the lower portion of the chamber and the proximal end being positioned above the distal end and opening downward at an angle into the lower portion of the chamber, the chamber being in fluid communication with liquid in the vessel through the inlet/outlet means which allows for entry of the liquid into the dispenser, wherein, upon dispensing material from said dispenser, water is caused to enter the distal end of the inlet/outlet means, be discharged from the proximal end at turbulent flow and be deflected off the distal side wall of the lower portion of the chamber, thereby assisting in the dilution or dissolution of the material.

19. The dispenser according to claim 18, wherein the lower portion of the chamber is retractable within the upper portion.

20. The dispenser according to claim 18, wherein the inside dimension of the inlet/outlet means is sized such that water which enters the chamber through the inlet/outlet means generates turbulence within the center of the inlet/outlet means having a maximum Reynold's number within the range of between about Re 224 and about Re 18,000.

21. A process for cleaning a toilet, said process comprising the steps of:

(a) providing a dispenser comprising:

(i) a chamber having a lower portion closed at its bottom end and proximal and distal side walls extending from the bottom end, and an upper portion open at its top end, the top end capable of receiving a lavatory cleanser composition, and (ii) inlet/outlet means, the inlet/outlet means comprising a conduit attached to the proximal side wall of the lower portion of the chamber, the conduit having a proximal end and a distal end, the distal end being adjacent the bottom end of the lower portion of the chamber and the proximal end being positioned above the distal end and opening downward at an angle into the lower portion of the chamber, the chamber being in fluid communication with water in the toilet tank through the inlet/outlet means which allows for entry of the water into the dispenser after flushing the toilet;

(b) disposing a lavatory cleanser composition in the dispenser of (a); and (c) flushing the toilet, wherein after flushing the toilet, water is caused to enter the distal end of the inlet/outlet means, be discharged from the proximal end at turbulent flow and be deflected off the distal side wall of the lower portion of the chamber, thereby assisting in the dilution or dissolution of the lavatory cleanser composition, whereby a diluted or solubilized lavatory cleanser composition, is dispensed into the toilet tank and delivered to the toilet for cleaning thereof.

22. The process according to claim 21, wherein the lower portion of the chamber is retractable within the upper portion.

23. The process according to claim 21, wherein the lavatory cleanser composition comprises:

(i) at least one cleansing agent;

(ii) a fragrance component; and (iii) a dye.

24. The process according to claim 23, wherein the lavatory cleanser composition further comprises a bleaching agent.

25. The process according to claim 23, wherein the cleansing agent is a surfactant.

26. The process according to claim 25, wherein the surfactant is an anionic surfactant which may be combined with a nonionic surfactant with a hydrophobic/lipophobic balance within the range of about 12 to about 25, an amphoteric surfactant or combinations thereof.

27. The process according to claim 21, wherein the lavatory cleanser composition is an oxidant selected from the group consisting of trichloroisocyanuric acid, chlorinated s-triazine triones, sodium dichloroisocyanurate dihydrate, calcium hypochlorite, bromochlorodimethylhydantoin, dichlorodimethylhydantoin, trichloromelamine, odium perborate monohydrate, sodium perborate tetrahydrate, calcium peroxide, zinc peroxide, percarbamide, and sodium percarbonate.

28. The process according to claim 21, wherein the inside dimension of the inlet/outlet means is sized such that water which enters the chamber through the inlet/outlet means generates turbulence within the center of the inlet/outlet means having a maximum Reynold's number within the range of between about Re 224 and about Re 18,000.

29. A process for using a lavatory cleanser composition in a dispenser, said process comprising the steps of:

(a) providing a dispenser adapted for mounting in a toilet tank, the dispenser comprising:

(i) at least one chamber, the chamber having a lower portion closed at its bottom end and proximal and distal side walls extending from the bottom end, and an upper portion open at its top end, the top end capable of receiving a lavatory cleanser composition, and (ii) at least one inlet/outlet means, the inlet/outlet means comprising a conduit attached to the proximal side wall of the lower portion of the chamber, the conduit having a proximal end and a distal end, the distal end being adjacent the bottom end of the lower portion of the chamber and the proximal end being positioned above the distal end and opening downward at an angle into the lower portion of the chamber, the chamber being in fluid communication with water in the toilet tank through the inlet/outlet means which allows for entry of the water into the dispenser after flushing the toilet;

(b) providing a lavatory cleanser composition, the lavatory cleanser composition being disposed within a lower portion of the chamber; and (c) flushing the toilet, wherein, after flushing the toilet, water is caused to enter the distal end of the inlet/outlet means, be discharged from the proximal end at turbulent flow and be deflected off the distal side wall of the lower portion of the chamber, thereby assisting in diluting or solubilizing the lavatory cleanser composition disposed in the lower portion of the chamber which, as the water level in the toilet tank rises, fills a portion of the upper portion of the chamber with the diluted or solubilized lavatory cleanser composition and when the toilet is being flushed dispensing to the toilet tank for delivery into the toilet bowl substantially all of the diluted or solubilized portion of the lavatory cleanser composition located in the upper portion of the chamber through the inlet/outlet means.

30. The process according to claim 29, wherein the lower portion of the chamber is retractable within the upper portion.

31. The process according to claim 29, wherein the lavatory cleanser composition comprises:

(i) at least one cleansing agent;

(ii) a fragrance component; and (iii) a dye.

32. The process according to claim 31, wherein the lavatory cleanser composition further comprises a bleaching agent.

33. The process according to claim 31, wherein the cleansing agent is a surfactant.

34. The process according to claim 33, wherein the surfactant is an anionic surfactant which may be combined with a nonionic surfactant with a hydrophobic/lipophobic balance within the ranged of about 12 to about 25, an amphoteric surfactant or combinations thereof.

35. The process according to claim 29, wherein the lavatory cleanser composition is an oxidant selected from the group consisting of trichloroisocyanuric acid, chlorinated s-triazine triones, sodium dichloroisocyanurate dihydrate, calcium hypochlorite, bromochlorodimethylhydantoin, dichlorodimethylhydantoin, trichloromelamine, odium perborate monohydrate, sodium perborate tetrahydrate, calcium peroxide, zinc peroxide, percarbamide, and sodium percarbonate.

36. The process according to claim 29, wherein the inside dimension of the inlet/outlet means is sized such that water which enters the chamber through the inlet/outlet means generates turbulence within the center of the inlet/outlet means having a maximum Reynold's number within the range of between about Re 224 and about Re 18,000.

37. The process according to claim 29, wherein the lavatory cleanser composition is a solid.

38. The process according to claim 37, wherein the solid lavatory cleanser composition is inserted within the upper portion of the container so that it may be disposed within the lower portion of the chamber.

39. A lavatory cleansing system consisting essentially of:

(a) a dispenser adapted for mounting in a toilet tank, said dispenser comprising:

(i) a chamber, the chamber having a lower portion closed at its bottom end, and an upper portion open at its top end, the top end capable of receiving a lavatory cleanser composition, and the lower portion of the chamber being retractable within the upper portion, and (ii) inlet/outlet means, the inlet/outlet means having a proximal end and a distal end, and (b) a lavatory cleanser composition, the lavatory cleanser composition of (b) being disposed within the lower portion of the chamber (a)(i), the proximal end of the inlet/outlet means of (a)(ii) being attached to the chamber (a)(i) at an opening therein and the distal end of the inlet/outlet means (a)(ii) being positioned below the proximal end of the inlet/outlet means (a)(ii) and toward the lower portion of the chamber (a)(i), the chamber of (a)(i) being in fluid communication with the water in the toilet tank through the inlet/outlet means, which allows for entry of the water into the dispenser of (a) after flushing the toilet, thereby assisting in the dilution or dissolution of the lavatory cleanser composition disposed in the lower portion of the chamber of (a)(i) which, as the water level in the toilet tank rises, fills a portion of the upper portion of the chamber of (a)(i) with diluted or solubilized lavatory cleanser composition and, when the toilet is being flushed, dispensing into the toilet tank through the inlet/outlet means of (a)(ii) for delivery to the toilet bowl substantially all of the diluted or solubilized portion of the lavatory cleanser composition located in the upper portion of the chamber of (a)(i).

40. The cleaning system according to claim 39, wherein the lavatory cleanser composition comprises:

(i) at least one cleansing agent;

(ii) a fragrance component; and (iii) a dye.

41. The cleaning system according to claim 40, wherein the lavatory cleanser composition further comprises a bleaching agent.

42. The cleaning system according to claim 40, wherein the cleansing agent is a surfactant.

43. The cleaning system according to claim 42, wherein the surfactant is an anionic surfactant which may be combined with a nonionic surfactant with a hydrophobic/lipophobic balance within the range of about 12 to about 25, an amphoteric surfactant or combinations thereof.

44. The cleaning system according to claim 39, wherein the lavatory cleanser composition is an oxidant selected from the group consisting of trichloroisocyanuric acid, chlorinated s-triazine triones, sodium dichloroisocyanurate dihydrate, calcium hypochlorite, bromochlorodimethylhydantoin, dichlorodimethylhydantoin, trichloromelamine, odium perborate monohydrate, sodium perborate tetrahydrate, calcium peroxide, zinc peroxide, percarbamide, and sodium percarbonate.

45. The cleaning system according to claim 39, wherein the inside dimension of the inlet/outlet means is sized such that water which enters the chamber through the inlet/outlet means generates turbulence within the center of the inlet/outlet means having a maximum Reynold's number within the range of between about Re 224 and about Re 18,000.

46. A dispenser, adapted for mounting in a tank of a toilet, which is capable of dispensing a conserved amount of diluted or solubilized lavatory cleanser composition by controlling the rate at which water from the toilet tank enters said dispenser, said dispenser comprising:

(a) at least one chamber, the chamber having a lower portion closed at its bottom end and proximal and distal side walls extending from the bottom end, and an upper portion open at its top end, the top end capable of receiving a lavatory cleanser composition; and (b) at least one inlet/outlet means, the inlet/outlet means comprising a conduit attached to the proximal side wall of the lower portion of the chamber, the conduit having a proximal end and a distal end, the distal end being adjacent the bottom end of the lower portion of the chamber and the proximal end being positioned above the distal end and opening downward at an angle into the lower portion of the chamber, the chamber suitable for being in fluid communication with water in the toilet tank through the inlet/outlet means which allows for entry of the water into the dispenser, wherein, in use, water can be caused to enter the distal end of the inlet/outlet means, be discharged from the proximal end at turbulent flow and be deflected off the distal side wall of the lower portion of the chamber, thereby assisting in the dilution or dissolution of the lavatory cleanser composition when being dispensed.

47. The dispenser according to claim 46, wherein the lower portion of the chamber is retractable within the upper portion.

48. The dispenser according to claim 46, wherein the lavatory cleanser composition comprises:

(i) at least one cleansing agent;

(ii) a fragrance component; and (iii) a dye.

49. The dispenser according to claim 48, wherein the lavatory cleanser composition further comprises a bleaching agent.

50. The dispenser according to claim 48, wherein the cleansing agent is a surfactant.

51. The dispenser according to claim 50, wherein the surfactant is an anionic surfactant which may be combined with a nonionic surfactant with a hydrophobic/lipophobic balance within the range of about 12 to about 25, an amphoteric surfactant or combinations thereof.

52. The dispenser according to claim 46, wherein the lavatory cleanser composition is an oxidant selected from the group consisting of trichloroisocyanuric acid, chlorinated s-triazine triones, sodium dichloroisocyanurate dihydrate, calcium hypochlorite, bromochlorodimethylhydantoin, dichlorodimethylhydantoin, trichloromelamine, odium perborate monohydrate, sodium perborate tetrahydrate, calcium peroxide, zinc peroxide, percarbamide, and sodium percarbonate.

53. The dispenser according to claim 46, wherein the inside dimension of the inlet/outlet means is sized such that water which enters the chamber through the inlet/outlet means generates turbulence within the center of the inlet/outlet means having a maximum Reynold's number within the range of between about Re 224 and about Re 18,000.

* * * * *